US005327603A

United States Patent [19]

Roh et al.

[11] Patent Number: 5,327,603

[45] Date of Patent: Jul. 12, 1994

[54] COMBINED PULSATOR AND DRUM TYPE WASHING MACHINE

[75] Inventors: Yang H. Roh; Ho C. Kwon, both of Changwon-si, Kyungsangnam-do, Rep. of Korea

[73] Assignee: Goldstar Co., Ltd., Seoul, Rep. of Korea

[21] Appl. No.: 913,726

[22] Filed: Jul. 16, 1992

[30] Foreign Application Priority Data

| | | | |
|---|---|---|---|
| Jul. 16, 1991 | [KR] | Rep. of Korea | 12128/1991 |
| Oct. 10, 1991 | [KR] | Rep. of Korea | 16832/1991 |
| Oct. 11, 1991 | [KR] | Rep. of Korea | 17890/1991 |
| May 29, 1992 | [KR] | Rep. of Korea | 9312/1992 |

[51] Int. Cl.[5] ..... D06F 23/02; D06F 23/04

[52] U.S. Cl. ..... 8/159; 68/24; 68/25; 68/131; 68/139

[58] Field of Search ..... 68/24, 25, 139, 131, 68/210; 8/159

[56] References Cited

U.S. PATENT DOCUMENTS

| | | | |
|---|---|---|---|
| 1,397,652 | 11/1921 | Pierce | 68/25 |
| 1,629,856 | 5/1927 | Boughton | 68/25 X |
| 1,886,201 | 11/1932 | Lange | 68/25 |
| 2,343,102 | 2/1944 | Wesely | 68/25 X |
| 3,302,433 | 2/1967 | Nallinger | 68/25 X |
| 5,074,131 | 12/1991 | Hirose et al. | 68/25 |
| 5,111,673 | 5/1992 | Kadoya et al. | 68/25 |

*Primary Examiner*—Frankie L. Stinson
*Attorney, Agent, or Firm*—Fish & Richardson

[57] ABSTRACT

This invention provides a combined washing machine in which pulsator type and drum type washing machine features are united such that they can be selectively utilized depending upon a desired washing condition, thereby executing optimal washing operation. The combined washing machine comprises a washing drum having both of a plurality of lifters, as in a drum type machine, and a pulsator, as in a pulsator type machine, and being rotatable through 90° between vertical and horizontal positions by means of a driving device.

11 Claims, 7 Drawing Sheets

PPIOR ART

COMBINED PULSATOR AND DRUM TYPE WASHING MACHINE

BACKGROUND OF THE INVENTION

1. Field of the Invention

This invention relates to a combined pulsator and drum type washing machine in which a pulsator type washing machine feature carrying out washing operation by virtue of rotation of a pulsator and a drum type washing machine feature carrying out washing operation by virtue of rotation of a drum are united such that they can be selectively utilized depending upon washing conditions.

2. Description of the Prior Art

Among various washing machines which have been used in the past, a pulsator type washing machine is of the type as shown in FIG. 1 of the accompanying drawings and comprises a single, combined washing and dehydration drum (will be hereinafter simply referred to as a "washing drum") 2 vertically disposed within a tub 1, a dehydrating shaft 3 coupled to the washing drum 2, a pulsator 4 rotatably disposed on the inner bottom of the drum 2, a pulsator shaft 5 fixed to the pulsator 4, a motor 6, and a clutch spring 7 disposed to selectively transmit power of the motor to the drum 2 and the pulsator 4 such that the drum and the pulsator are separately rotated selectively depending upon a given condition.

With this construction, during washing operation, when the power of the motor 6 is transmitted to the pulsator shaft 5 via the clutch spring 7, the pulsator 4 fixed to the pulsator shaft 5 for rotation therewith executes alternately forward and reverse rotations to carry out a washing function by tumbling over, rubbing or pressing articles to be washed, which are placed above the pulsator. During dehydrating operation, the driving force of the motor 6 is transmitted to the dehydrating shaft 3 by means of the clutch spring 7 such that the washing drum 2 coupled to the dehydrating shaft for rotation therewith is rotated to carry out the dehydration.

A drum type washing machine comprises, as shown in FIG. 2, a washing drum 2 horizontally disposed within a tub 1 and provided on its inner peripheral surface with a plurality of equally spaced lifters 11, a drum shaft 12 coupled to the washing drum and supported by a bearing contained in a bearing housing 13, a drum pulley 14 fixed to the rear end of the drum shaft 12, and a motor 15 secured to the underside of the tub 1 and having pulley 16 which is operatively connected to the drum pulley 14 by an endless belt 17 running around the pulleys, whereby the drum pulley may be rotated by the driving force of the motor.

With this construction, when the motor 15 is energized, the driving force of the motor is transmitted through the motor pulley 16, the belt 17, the drum pulley 14 and the drum shaft 12 to the washing drum 2 to rotate the drum. During the rotation of the drum, the articles to be washed are lifted and pressed by the lifters 11 formed on the inner periphery of the drum 2, and then dropped downwardly within the drum. Therefore, washing and dehydrating operations are carried out by an impact resulting from the dropping.

However, the pulsator type washing machine effecting washing operation by tumbling over, rubbing or pressing the articles to be washed is advantageous in that the washing may be accomplished in a short period of time, but has serious drawbacks in that the articles may be easily damaged and washing nonuniformity may appear. To the contrary, the drum type washing machine is advantageous in that since it effects washing operation by the impact generated when the articles to be washed are lifted and pressed by the lifters of the washing drum, and then dropped downwardly within the drum, although the drum is filled with large quantities of the articles, uniform washing may be achieved. However, the drum type machine has a drawback in that it takes relatively long time to carry out the washing operation.

Further, in case of the drum type machine, since the rotational axis of the drum crosses at a right angle with the direction of the gravity of the drum, vibration is produced due to an unbalance of the weight of the drum during the dehydration. In order to prevent such vibration, therefore, the washing machine must necessarily be provided with a counterbalance, resulting in increasing the weight. In addition, differently from the pulsator type, the user requires to inconveniently bend the body in order to put in and take out the articles at the front side of the machine.

There is accordingly a need to provide a combined washing machine having both of the pulsator type washing function and drum type washing function, and thus being capable to utilize only advantages of the pulsator and drum types, thereby to selectively carry out the washing and dehydrating modes depending upon the kinds of the articles to be washed and washing conditions.

SUMMARY OF THE INVENTION

The present invention has therefore been made in view of the above-mentioned need, and has an object to provide a combined washing machine in which pulsator type and drum type washing machine features are united such that the user can selectively utilize the combined features depending upon washing conditions and the kinds of articles to be washed, without purchasing separately a pulsator type washing machine and a drum type washing machine.

To achieve the above object, there is provided according to the first form of the present invention a combined washing machine comprising a washing drum having a plurality of equally spaced lifters provided on its inner periphery and a pulsator disposed on its inner bottom, and being rotatable through an angle of 90° between vertical and horizontal positions by means of a driving device to obtain a desired washing mode.

According to a second form of the present invention, there is provided a combined washing machine according to the first form, in which a gear meshed with a power transmission gear and secured to a bearing shaft of the washing drum to turn the drum is modified such that when a power failure or a breakdown occurs with a tub held in a horizontal position, the engagement of the gear with the power transmission gear can be released to permit a manual turning of the tub.

According to a third form of the present invention, there is provided a method of driving a combined washing machine comprising the step of selectively controlling power being supplied to driving motors, thereby to rotate a pulsator and a washing drum in opposite directions each other during pulsator type washing operation, to rotate only the washing drum during drum type washing operation and to rotate the pulsator and the drum in the same direction during dehydration.

DESCRIPTION OF THE PREFERRED EMBODIMENTS

The invention will now be described in more detail, by way of example, with reference to FIGS. 3 to 8 of the accompanying drawings.

Figure 1:
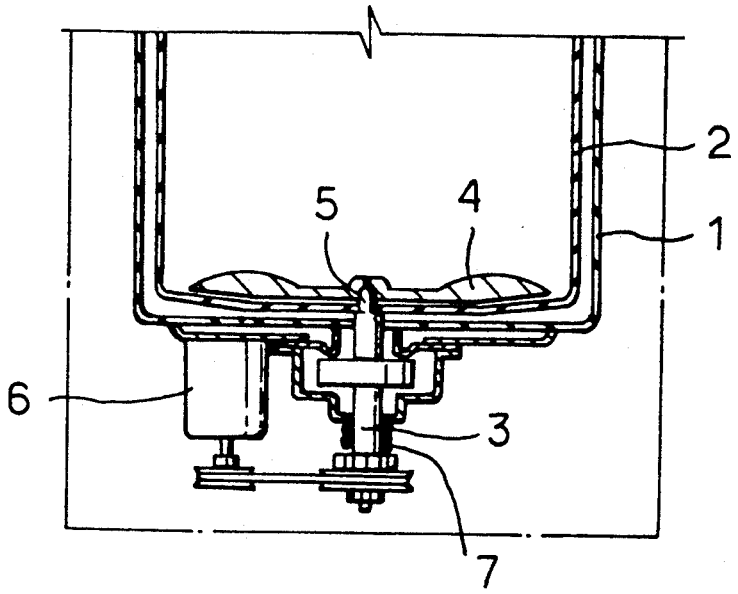
FIG.1 PRIOR ART
FIG. 1 is a partial cross-sectional view showing the important parts of a conventional pulsator type washing machine.
Figure 2:
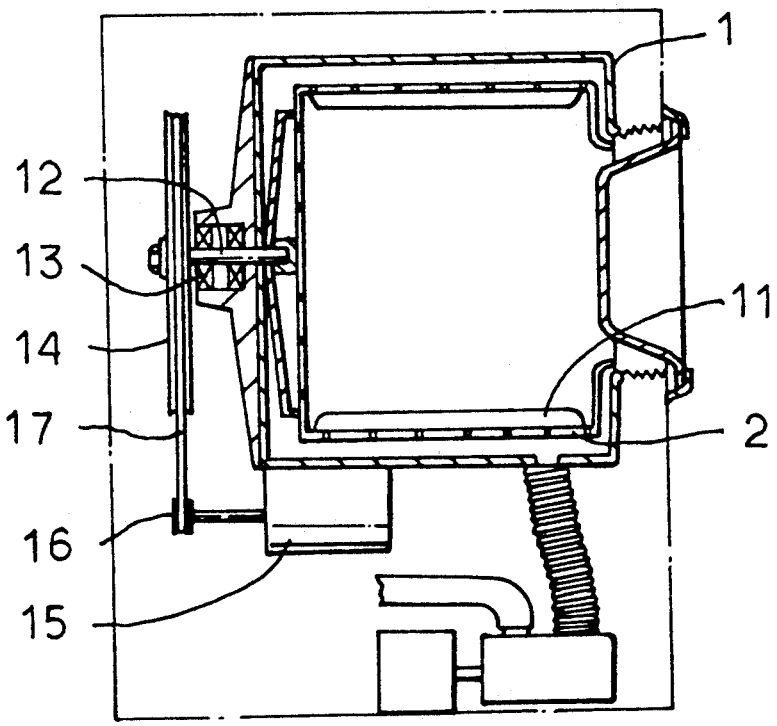
FIG. 2 is a cross-sectional view showing the important parts of a conventional drum type washing machine.
Figure 3:
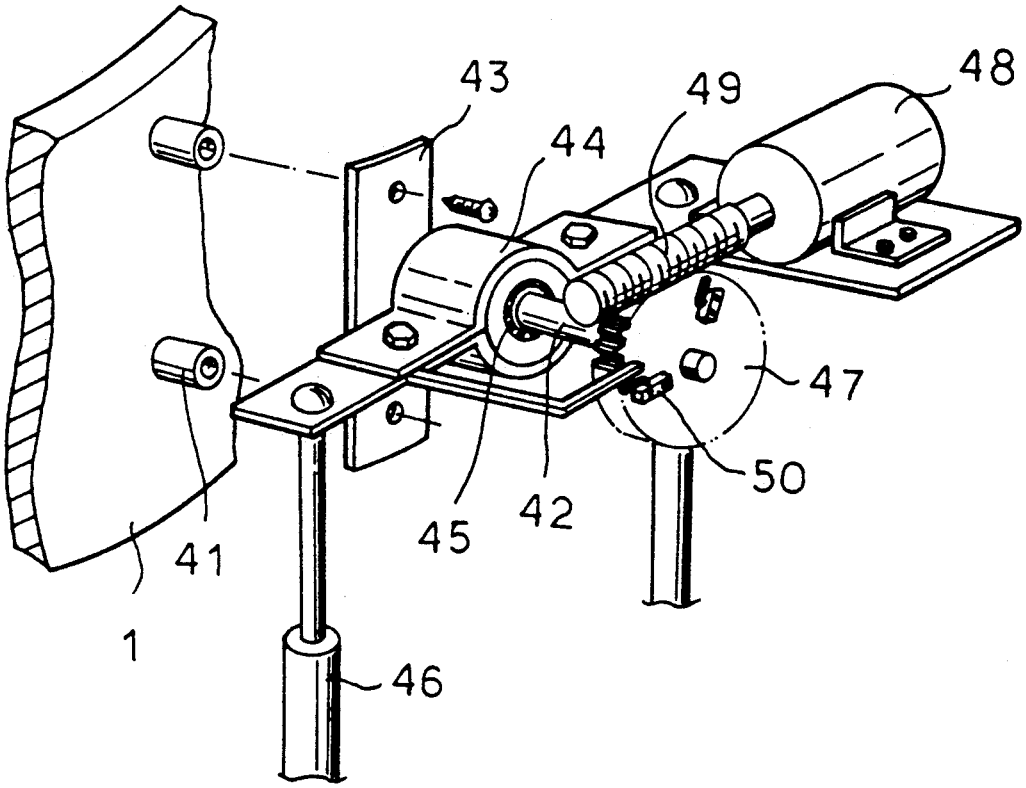
FIG. 3 is a perspective view of a driving device for turning a tub of a combined washing machine according to one embodiment of the present invention.
Figure 4:
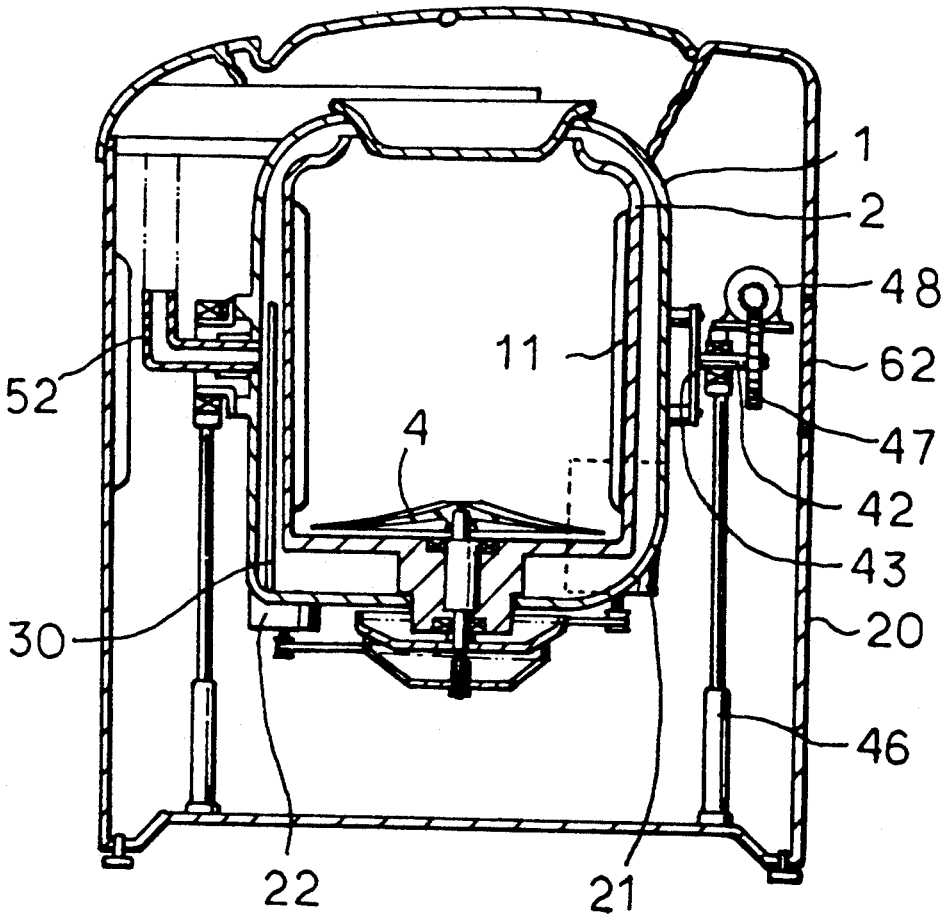
FIG. 4 is a cross-sectional view of the combined washing machine of the present invention with the tub held in an upright position.
Figure 5:
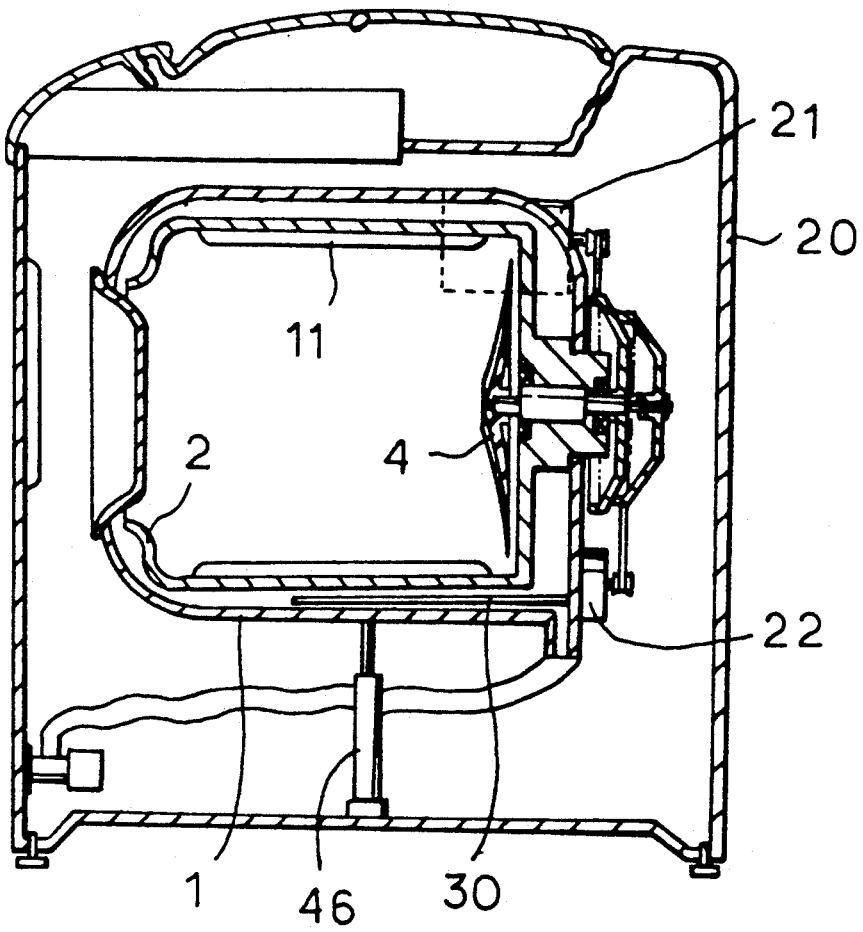
FIG. 5 is a cross-sectional view of the washing machine of the present invention with the tub held in a horizontal position.

Reference is first made to FIGS. 3 and 4 illustrating a combined a tub 1 held in an upright position, as in a conventional pulsator type washing machine, and FIG. 5 is a longitudinal cross-sectional view of the washing machine in a horizontal position according to one embodiment of the present invention.

The basic components of the washing machine, such as a tub, a washing drum, a drum motor for driving the washing drum, a pulsator motor for driving a pulsator, etc. are substantially identical in construction and operation with those of the conventional pulsator type and drum type washing machines, and thus not described in further detail here.

According to the present invention, the washing drum 2 is provided on its inner peripheral surface with a plurality of equally spaced lifters 11, which are disposed at only the drum-type washing machine of both machines, and on its inner bottom with a pulsator 4, which is disposed at only the pulsator type washing machine.

With this construction, when a pulsator motor 22 is actuated with the drum 2 held in the upright position as shown in FIG. 4, the pulsator 4 is rotated, thereby carrying out a pulsator type washing function. To the contrary, in the horizontal position of the washing drum as shown in FIG. 5, the drum 2 is rotated by actuation of a drum motor 21, thereby executing a drum type washing function. For selection of the washing modes, there is provided a driving device for turning the washing drum through an angle of 90°, as shown in FIG. 3 which illustrates in exploded perspective the construction of the device when the drum is in the upright position.

The tub 1 has two pairs of bosses 41 formed centrally on its outer periphery, one pair on each of the opposite sides thereof. Fixing members, such as fixing plates 43, each having a bearing shaft 42 are attached one to each pair of the bosses 41, for example by means of screws. The bearing shaft 42 is supported by a bearing 45 in a bearing housing 44 to facilitate turning of the tub 1. Alternatively, the fixing plates 43 may be directly attached to the outer periphery of the tub 1 without forming the bosses 41 on the outer periphery of the tub.

Further, preferably, damping means such as dampers 46 extending upwardly from the bottom of the washing machine are coupled to the opposite sides of the bearing housing 44 to damp vibration generated during the washing or dehydrating operations. Any commercially available dampers of various forms for damping vibration may be used as the dampers 46.

Mounted on the free end of the bearing shaft 42 passed through the bearing 45 in the bearing housing 44 is a gear 47, which is meshed with a power transmission gear 49 connected to a motor 48, such that turning of the tub 1 between the vertical and horizontal positions may be accomplished through rotation of the bearing shaft 42 by actuation of the motor 48.

Although in the embodiment shown in FIG. 3, the gear 47 and the power transmission gear 49 are in the forms of a worm gear and a worm, respectively, the gears may be helical gears, or any other power transmission means, for example, a chain or a belt.

Upon actuation of the motor 48, the tub 1 is turned by a driving force transmitted thereto through the path comprising the power transmission gear 49, the gear 47 and the bearing shaft 42. At this time, since it is necessary to control a rotational angle of 90° between the vertical and horizontal positions of the tub, means for controlling such a rotational angle must be provided. To this end, although the motor 48 may be replaced with a step motor to precisely control the limits of forward and reverse rotations of the motor, in the embodiment shown in FIG. 3, a pair of limit switches 50 are disposed on one side surface of the gear 47 in 90° spaced-apart relation to each other, and a limit bar 51 for actuating the limit switches is attached to and extends from the bearing housing 44. With this arrangement, as the gear 47 rotates, the limit switches 50 are selectively brought into contact with the limit bar 51 to control the forward and reverse rotations of the motor 48. This arrangement eliminates the need for using the expensive precise step motor.

In addition, as shown in FIG. 4, the bearing shaft 42 provided on the opposite side of the tub to be connected to a water supply port 52 for supplying water to the interior of the washing drum 2 is preferably of a hollow shaft shape to also serve as a water supply pipe, and constructed so as not to cause interference during the turning of the tub. Moreover, preferably, a heater 30 may be disposed between the tub 1 and the drum 2 to heat washing water in the drum in response to a sensed temperature of the water, thereby providing enhanced washing efficiency, as achieved in boiling type laundering.

The combined washing machine of the present invention thus constructed can carry out the washing operation in various modes with a desired position of the washing drum 2 optionally selected between the upright position for a pulsator type washing mode and the horizontal position for a drum type washing mode through actuation of a switch of a control panel (not shown) of the machine. At this time, the washing and rinsing modes are carried out with the drum 2 held in the horizontal position, as in the drum type machine, and after completion of the washing and rinsing, the drum is turned to the upright position, as in the pulsator type machine, to effect the dehydration. As a result, effective washing can be accomplished in a shorter period of time with vibration and noise considerably reduced.

Alternatively, the washing program may be divided into a normal washing program in which the washing is carried out as described above, and a quick washing program in which the washing drum 2 in the upright position and the pulsator 4 rotate in opposite directions of each other such that the articles to be washed can be rubbed by both of the lifters 11 of the drum and the pulsator, whereby the washing can be carried out in a shorter period of time. Further, in the event of washing a small quantity of a laundry, the washing may be carried out with the drum 2 tilted by an angle of about 45° without turning it through 90° to the vertical position or the horizontal position, as a result of which saving of the washing water may be achieved.

In case of the combined washing machine, when a power failure occurs during the drum type washing operation with the tub turned to the horizontal position, the tub can not be turned to the upright position, and thus it is impossible to take out the articles in the drum. This is because the articles are put in and taken out through a door provided at the top of the machine, with the tub held in the upright position. Therefore, to overcome this problem, the above embodiment of the present invention is modified such that when a power failure or a breakdown occurs with the tub held in the horizontal position, the engagement of the power transmission gear with the gear for turning the tub can be released to permit the tub to be turned manually.

Figure 6:
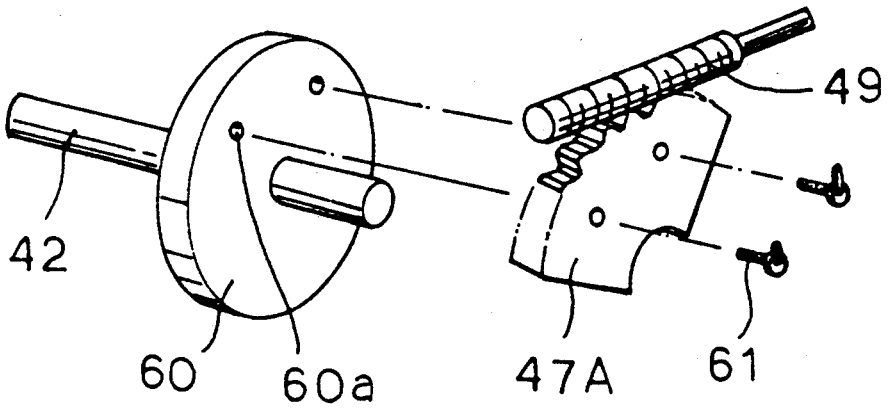
FIG. 6 is an exploded perspective view showing a modification of the driving device shown in FIG. 3.

To this end, in the modification as shown in FIG. 6, the power transmission gear 49 for transmitting the rotational force of the motor 48 to the bearing shaft 42 is not engaged with the gear 47 directly secured to the bearing shaft as shown in FIG. 3, but, instead, is meshed with a gear 47A having through holes, which is, in turn, fastened by fastening bolts 61 to a disc 60 having fastening holes **60*a* and secured to the bearing shaft 42. In this case, the gear 47A to be fastened to the disc 60 may be either a circular disc gear similar to the gear 47 shown in FIG. 3, or a sector gear as shown in FIG. 6. The reason for this is that the gear 47A** requires only 90° rotation.

Figure 6A:
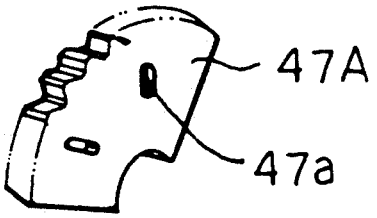
FIG. 6*a* is a view of another modification of the driving device.
Figure 7:
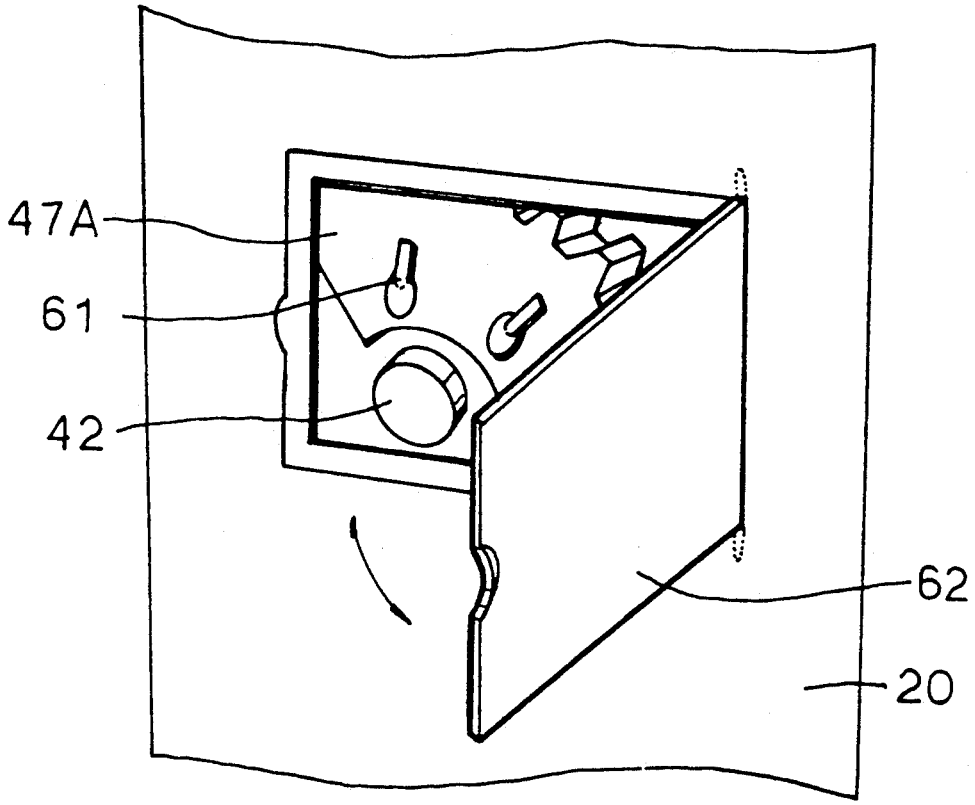
FIG. 7 is a view showing a door for a gear, which is open to manipulate the driving device of FIG. 6.

Since according to this modification the gear 47A can be assembled to or disassembled from the disc 60 by means of the fastening bolts 61, when the power failure or the breakdown occurs with the tub turned to the horizontal position, the gear 47A can be disassembled from the disc 60 through an openable door 62, which is provided at one side wall of a machine casing 20 as shown in FIG. 7, thereby allowing the tub to be turned manually. At this time, in order that the engagement of the gear 47A with the power transmission gear 49 can be released by loosening the fastening of the bolts 61 without completely dismounting the gear from the disc 60, each of the through holes of the gear 47A corresponding in position to the fastening holes **60*a* of the disc may be of the shape of an elongated hole 47*a*, as shown in FIG. 6*a*, which preferably has length enough to release the engagement of the gear 47A with the power transmission gear 49** to permit the manual rotation of the tub without completely disassembling the gear.

Figure 8:
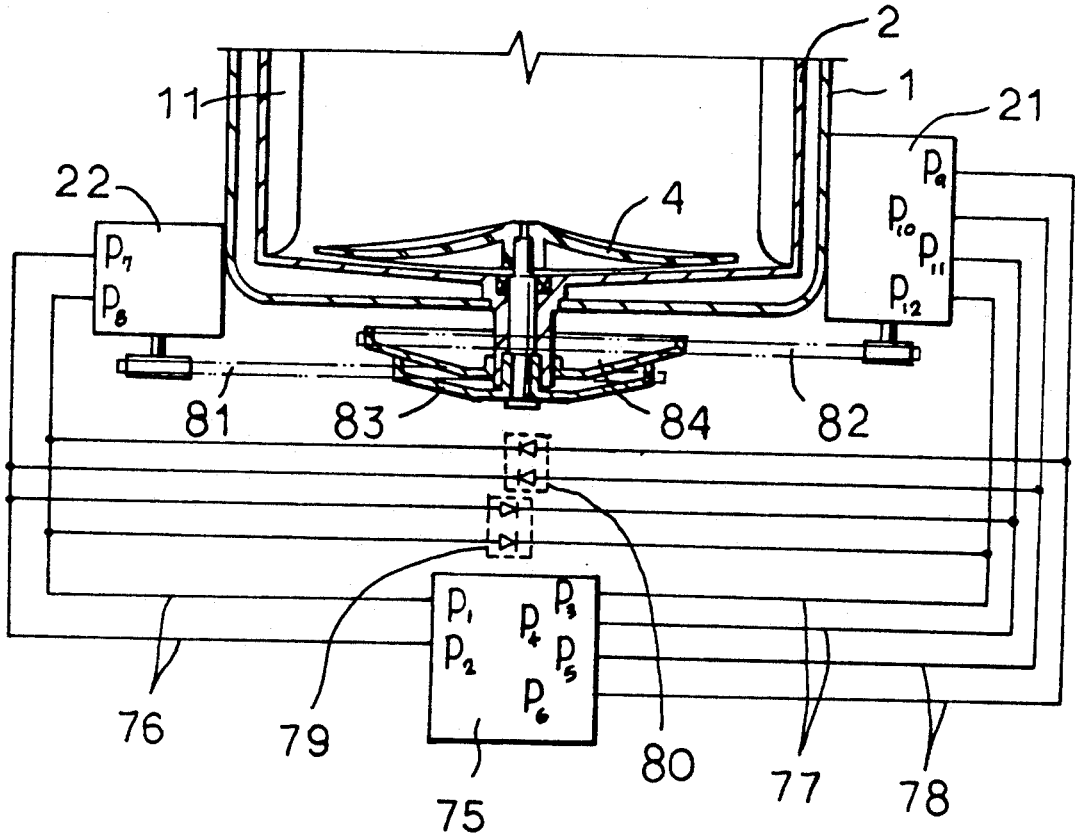
FIG. 8 is a view showing a circuit for operation of the combined washing machine according to another embodiment of the present invention.

According to another aspect of the present invention, there is provided a method of driving the combined washing machine in an optimal washing mode by controlling rotational directions and driving sequence of the motors for driving the washing drum and the pulsator in the drum. The construction of a control device for execution the driving method is shown in FIG. 8.

The control device comprises a power supply control section 75 for selectively supplying power to the washing drum motor 21 for driving the washing drum 2 and the pulsator motor 22 for rotating the pulsator 4, both of which motors are installed externally of the lower portion of the tub 1; first power supply lines 76 for supplying the power from the control section 75 to the pulsator motor 22; second and third power supply lines 77 and 78 for supplying the power from the control section 75 to the drum motor 21; first diodes 79 for interconnection of the first supply lines 76 and the second supply lines 77 such that the power being supplied from the control section 75 to the pulsator motor 22 via the first supply lines 76 can also be supplied to the drum motor 21 via the second supply lines 77; and second diodes 80 for interconnecting the first supply lines 76 and the third supply lines 78 such that the power being supplied from the control section 75 to the drum motor 21 via the third supply lines 78 can also be supplied to the pulsator motor 22 via the first supply lines 76. Symbols $P_1$–$P_6$ denote output terminals of the power supply control section 75, $P_7$ and $P_8$ input terminals of the pulsator motor 22, and $P_9$–$P_{12}$ input terminals of the drum motor 21.

Operation of the control device thus constructed will now be explained. First, since the electric power having a positive phase is supplied to the drum motor 21 through the input terminals $P_9$,$P_{10}$, while the electric power to be supplied to the drum motor through the input terminals $P_{11}$,$P_{12}$ is converted to rotate the motor in a reverse direction.

During the pulsator type washing operation, when the power is supplied to the input terminals $P_7$, $P_8$ of the pulsator motor 22 through the first power supply lines 76 connected to the output terminals $P_1$, $P_2$ of the power supply control section 75, the power is also supplied by the first diodes 79 to the input terminals $P_{11}$,$P_{12}$ of the drum motor 21 through the second power supply lines 77 connecting the drum motor to the control section. At this time, since in terms of design of the circuit the power being input to the terminals $P_{11}$,$P_{12}$, has a negative phase, the pulsator motor 22 and the drum motor 21 rotate in opposite directions of each other. Therefore, the rotational forces of the pulsator motor 22 and the drum motor 21 are transmitted through belts 81, 82 to a pulsator pulley 83 and a washing drum pulley 84, respectively, so that the pulsator 4, on which the articles to be washed are put, and the washing drum 2 are rotated in opposite directions each other.

When the drum type washing operation is carried out with the tub 1 held in the horizontal position, the drum motor 21 is rotated in a given direction by the power supplied from the power supply control section 75 through the second power supply lines 77 to the input terminals $P_{11}$,$P_{12}$ of the motor, to rotate the washing drum in a corresponding direction, thereby executing the drum type washing. At this time, since the first diodes 79 interconnecting the first supply lines 76 and the second supply lines 77 are arranged in a reverse direction with respect to the power, the power being carried by the second supply lines 77 can not be supplied to the first supply lines 76. Therefore, the pulsator motor 22 is not actuated.

Then, when the dehydration is carried out with the tub held in the upright position, the power is supplied to the input terminals $P_9$,$P_{10}$ of the drum motor 21 through the third power supply lines 78 connected to the output terminals $P_5$, $P_6$ of the power supply control section 75, and simultaneously supplied to the terminals $P_7$,$P_8$ of the pulsator motor 22 via the second diodes 80. At this time, since the drum motor 21 and the pulsator motor 22 are rotated together in the same direction, the washed articles which have been put on the pulsator 4 before a start of the dehydration are thrust out of the pulsator, and then engaged with the inner periphery of the washing drum 2, thereby to undergo the dehydrating action.

The present invention provides advantages in that the washing operation can be carried out with enhanced washing efficiency and without damage to the laundry, and the excellent dehydration effect can be achieved by an increased centrifugal force provided by the pulsator and the washing drum, which are rotated in the same direction.

While the invention has been shown and described with particular reference to various embodiments thereof, it will be understood that variations and modifications in detail may be made therein without departing from the spirit and scope of invention as defined in the appended claims.

What is claimed is:

1. A combined pulsator and drum type washing machine comprising:

a washing drum having a plurality of lifters provided on its inner periphery and a pulsator rotatably disposed on its inner bottom;

a washing drum motor for driving said washing drum;

a pulsator motor for driving said pulsator;

a tub surrounding said washing drum;

fixing members each having a bearing shaft for turning said tub and secured to the opposite sides of the outer periphery of said tub;

bearing housings for rotatably guiding and supporting said bearing shafts to permit said tub to be turned smoothly;

means for rotating one of said bearing shafts to turn said tub between upright and horizontal positions for selectively washing in one of a plurality of washing modes; and a power supply control means for controlling rotational directions and driving of said washing drum and said pulsator motor.

2. A combined pulsator and drum type washing machine as claimed in claim 1, wherein said rotating means comprises a gear secured to said one of said bearing shafts, a power transmission gear meshed with said gear, and a motor for rotating said power transmission gear.

3. A combined pulsator and drum type washing machine as claimed in claim 2, wherein said gear is coupled to said bearing shaft via a disc which has fastening holes and is fixed to said bearing shaft, said gear being formed with through holes corresponding in position to said fastening holes.

4. A combined pulsator and drum type washing machine as claimed in claim 3, wherein each of said through holes of said gear is of an elongated hole shape.

5. A combined pulsator and drum type washing machine as claimed in claim 1, wherein said fixing members are fixing plates secured one to each of two pairs of bosses formed on the opposite sides of said tub.

6. A combined pulsator and drum type washing machine as claimed in claim 1, wherein the other of said bearing shafts is of a hollow shaft shape to constitute a water supply port for supplying water to the interior of said washing drum.

7. A combined pulsator and drum type washing machine as claimed in claim 1, wherein a heater is additionally disposed between said washing drum and said tub.

8. A combined pulsator and drum type washing machine as claimed in claim 2, wherein said gear has a pair of limit switches disposed on one side surface thereof in 90° spaced-apart relation to each other and actuated by a limit bar to control the range of a rotational angle of said gear.

9. A method of driving a combined pulsator and drum type washing machine including a washing drum having a pulsator and lifters, a washing drum motor for driving said washing drum, and a pulsator motor for rotating said pulsator, the method comprising the steps of:

selectively supplying power to said washing drum motor and said pulsator motor, and, based on said selectively supplied power, rotating said pulsator and said washing drum in opposite directions each other during pulsator type washing operation, rotating only said drum during drum type washing operation, and rotating said pulsator and said drum in the same direction during dehydration.

10. A method of carrying out a washing operation for a small quantity of laundry by a combined pulsator and drum type washing machine including a washing drum having a pulsator and lifters disposed within a tub, the method comprising the steps of:

slantingly arranging said tub at a predetermined one of a number of angles of inclination so as to permit the laundry and washing water in said washing drum to be collected at a lower corner portion of said drum, and then rotating said pulsator with said drum held in such an inclined position.

11. The method of claim 10 wherein said predetermined angle is selected from one of a number of angles ranging from a vertical angle to a horizontal angle.

* * * * *